United States Patent [19]

Majors

[11] Patent Number: 4,765,100

[45] Date of Patent: Aug. 23, 1988

[54] METHOD OF ABRADING NEW GARMENTS

[75] Inventor: Curtis O. Majors, Cincinnati, Ohio

[73] Assignee: Cookeville Uniform Rental, Inc., Cookeville, Tenn.

[21] Appl. No.: 49,208

[22] Filed: May 13, 1987

[51] Int. Cl.[4] ..... B24B 1/00

[52] U.S. Cl. ..... 51/313; 51/317; 51/164.1; 8/159; 26/28; 28/100; 68/29

[58] Field of Search ..... 51/164.1, 164.5, 313, 51/317, 298, 308; 26/27, 28; 28/100; 8/137, 142, 159; 68/29

[56] References Cited

U.S. PATENT DOCUMENTS

| | | | |
|---|---|---|---|
| Re. 29,709 | 7/1978 | Vissers | 209/86 |
| 1,760,218 | 5/1930 | Thibault et al. | 68/139 |
| 2,114,406 | 4/1938 | Simpson | 209/403 |
| 2,276,438 | 3/1942 | Van Buren et al. | 74/233 |
| 2,320,713 | 6/1943 | Brotman | 74/370 |
| 2,351,198 | 6/1944 | Friedman | 15/12 |
| 2,433,620 | 12/1947 | Monsaert, Sr. | 195/3 |
| 2,463,683 | 3/1949 | Fay | 38/143 |
| 2,540,717 | 2/1951 | Diether | 68/12 |
| 2,660,870 | 12/1953 | Kennedy | 68/24 |
| 3,071,900 | 1/1963 | Balz | 51/163 |
| 3,431,684 | 3/1969 | Ban | 51/164 |
| 3,469,959 | 9/1969 | Stein | 51/308 X |
| 3,513,604 | 5/1970 | Matsunaga et al. | 51/313 |
| 3,549,341 | 12/1970 | Kittredge | 51/308 X |
| 3,647,354 | 3/1972 | Loeb | 8/137 X |
| 3,808,747 | 5/1974 | Kenagy | 51/164.5 |
| 3,942,644 | 3/1976 | Vissers | 209/86 |
| 3,991,524 | 11/1976 | Ferrara | 51/163.1 |
| 4,218,220 | 8/1980 | Kappler et al. | 8/102 |
| 4,363,194 | 12/1982 | Balz | 51/163.1 |
| 4,380,137 | 4/1983 | Balz | 51/163.1 |
| 4,575,887 | 3/1986 | Viramontes | 8/158 |
| 4,674,691 | 6/1987 | Didion | 51/164.1 X |

FOREIGN PATENT DOCUMENTS

| | | | |
|---|---|---|---|
| 3126699 | 7/1981 | Fed. Rep. of Germany . | |
| 3129699 | 2/1983 | Fed. Rep. of Germany | 68/29 |

*Primary Examiner*—Frederick R. Schmidt
*Assistant Examiner*—Shirish Desai
*Attorney, Agent, or Firm*—Wood, Herron & Evans

[57] ABSTRACT

A method of "stone washing" jeans is disclosed. The process involves tumbling jeans without water and in the presence of resin-bonded abrasive members in a first elongated tumbler drum having a generally horizontal axis, discharging the jeans and abrasive members from the first tumbler drum, separating the abrasive members utilizing an oscillating conveyor, feeding the jeans to a second elongated tumbler drum having a perforated wall and a generally horizontal axis of rotation to remove any remaining abrasive members from the jeans and thereafter removing the treated jeans from the second tumbler drum while recycling the abrasive members to the first tumbler.

18 Claims, 3 Drawing Sheets

METHOD OF ABRADING NEW GARMENTS

BACKGROUND OF THE INVENTION

The present invention relates to a method of abrading, on a commercial scale, garments, particularly new denim blue jeans, to give the jeans a faded look of the type found desirable by many customers. In the past, new blue jeans have been commercially faded by subjecting the blue jeans to repeated washings. In some cases, large stones of pumice, or the like, have been added to the washer. In every instance, however, the blue jeans have been treated wet, i.e., in a water or chemical bath.

The prior art methods of commercially fading blue jeans have been subject to several defects. In the first place, repeated washing and rinsing steps, sometimes accompanied by bleaching and chemical treatment steps, are very time consuming. Moreover, the use of large pumice stones in a wet washing process has resulted in the production of tears and wear holes in garments as well as excessive and rapid wear on the washing machines. As a result, previous methods of fading blue jeans are expensive both because of the excessive processing time required and its attendant labor costs and the cost of maintaining and replacing damaged equipment.

Such methods are also disadvantageous in that they result in jeans which are not uniformly faded, but rather have objectionable streaks. Typical prior art patents disclosing wet methods of fading blue jeans are Kappler et al U.S. Pat. No. 4,218,220 and Viramontes U.S. Pat. No. 4,575,887.

SUMMARY OF THE PRESENT INVENTION

The present invention is directed to a new method of abrading garments on a commercial scale and, in particular, to a method of fading blue jeans which avoids the difficulties in the prior art methods described above. The present invention is predicated in part upon the concept of processing the blue jeans in a dry condition without subjecting them to water or chemicals.

In accordance with the present invention, the blue jeans and a large quantity of pre-formed sand and resin-bonded abrasive members are agitated in a first elongated tumbler having a drum which is rotatable along a generally horizontal axis. In a preferred embodiment, the drum is of polygonal cross-section with the jeans and abrasive members being added at one end and being discharged from the other. The jeans and abrasive members are discharged from the first tumbler onto a separating conveyor which separates most of the abrasive members from the jeans and recycles them to the first tumbler drum.

The jeans are then fed to the drum of a second tumbler, similar to the first, except that the second tumbler includes perforate walls. The jeans are rotated in the second tumbler which causes a separation of the remaining abrasive members from the jeans, including a separation of those abrasive members caught in the pockets of jeans. The jeans are subsequently discharged from the end of the second tumbler drum opposite to that in which they are loaded, while the separated abrasive members are recycled to the first drum.

One principal advantage of the present jean-fading method is that it is substantially more economical than the prior art wet methods. In the first place, the production rate at which jeans can be processed utilizing the present method is substantially faster than the rate achieved in typical prior art commercial methods. For example, in one system operated in accordance with the present method, jeans can be processed at a rate of three hundred per hour as compared with a rate of fifty per hour using a typical prior art machine.

A further advantage of the present invention is that the equipment utilized in the present method is not subject to an inordinate amount of wear and requires substantially less maintenance than washing machines of the type used in a typical commercial pumice stone washing process.

A still further advantage of the present invention is that the blue jeans processed by the present method have a highly desirable faded look with a uniform appearance free of undesirable streaks.

The present invention will be more readily understood from a consideration of the following detailed description of the drawings illustrating a preferred form of system for practicing the present method.

DETAILED DESCRIPTION OF THE DRAWINGS

DETAILED DESCRIPTION OF A PREFERRED EMBODIMENT

The present method of treating fabrics, such as denim blue jeans, involves, as a first step, tumbling the blue jeans in contact with abrasive members in a first rotary tumbler. The blue jeans are fed to the tumbler in a dry condition and there is no water present in the tumbler. In the next step, the abrasive members and blue jeans are separated as the blue jeans are conveyed to a second tumbler. Thereafter, the blue jeans, still in a dry condition, are tumbled in a second rotary tumbler to remove any remaining abrasive members from the mass of blue jeans. The treated blue jeans are then discharged from the second tumbler, while the abrasive elements separated from the jeans by the second tumbler and by the conveyor interconnecting the tumblers are recycled to the first tumbler.

Figure 1:
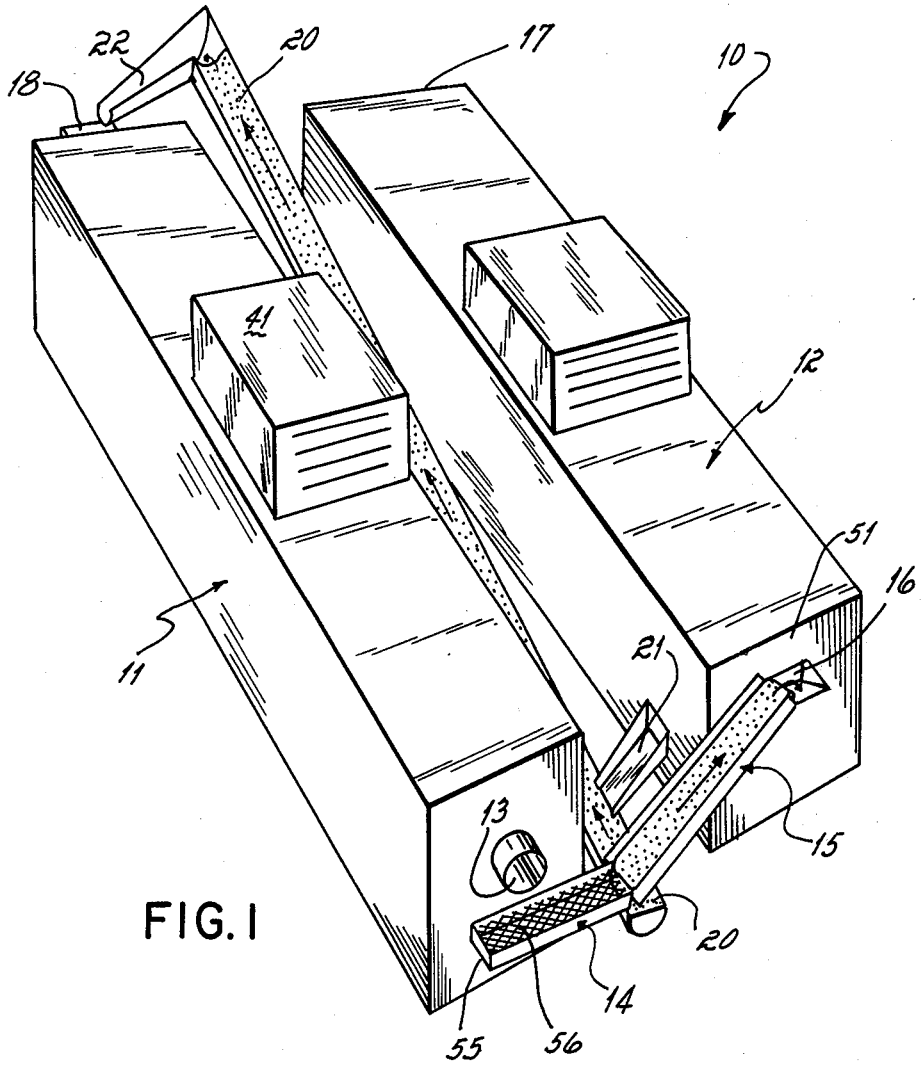
FIG. 1 is a semi-diagrammatic perspective view of a preferred system for practicing the present invention.
Figure 2:
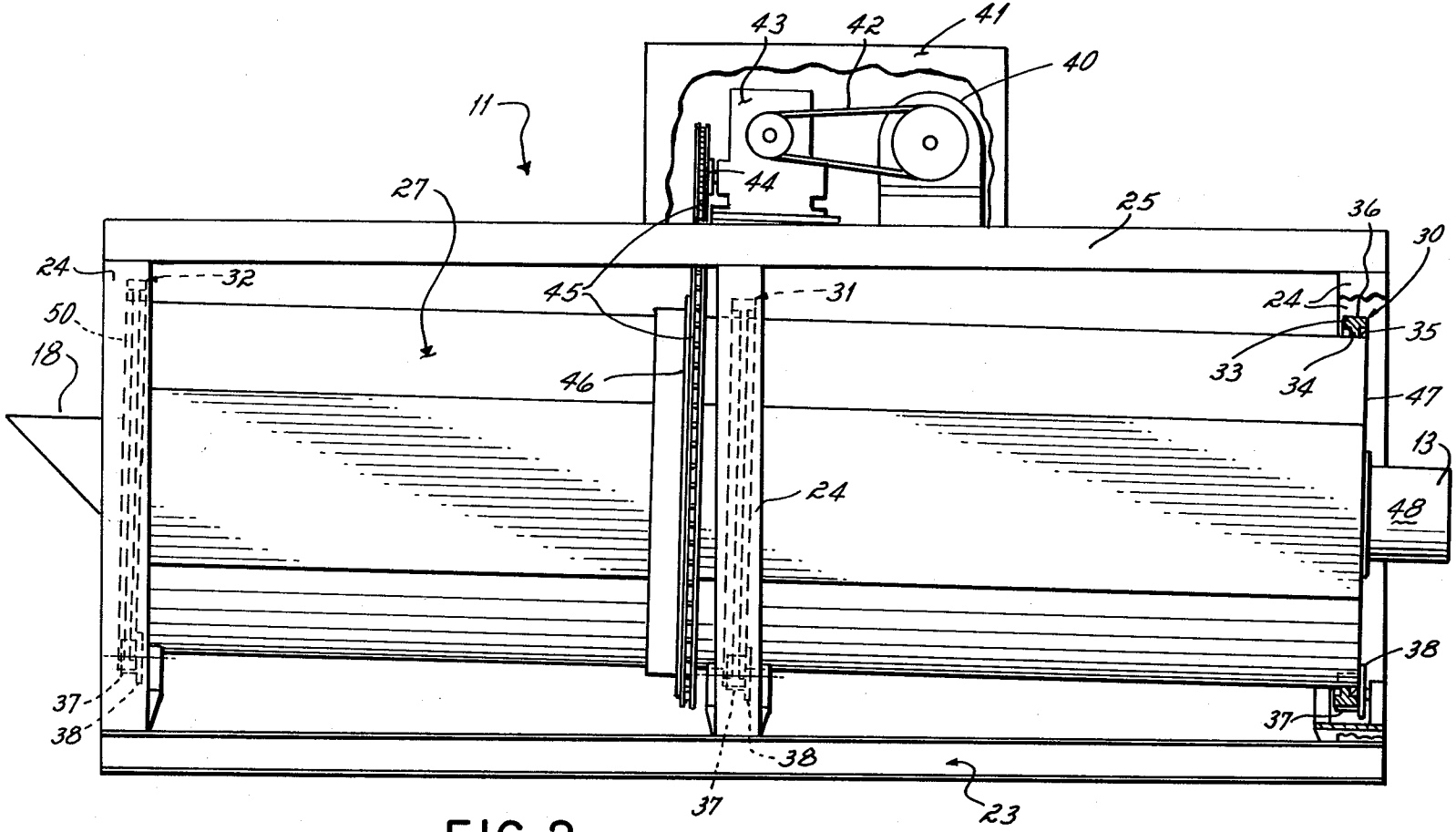
FIG. 2 is a side elevational view with the cover removed of one tumbler employed in practicing the present method.
Figure 3:
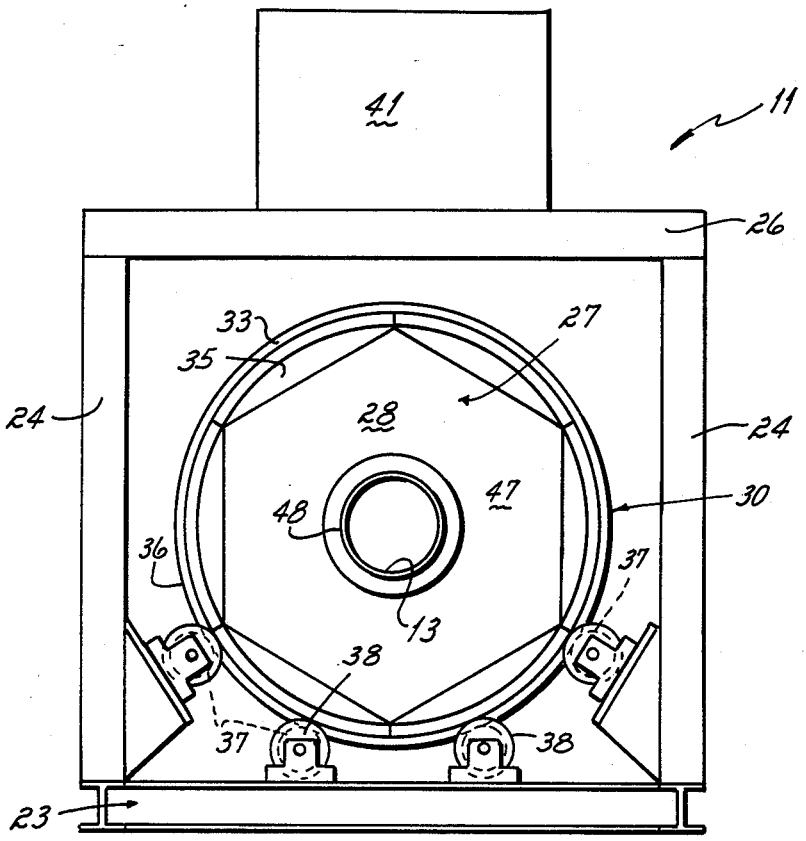
FIG. 3 is an end view of the tumbler of FIG. 2.
Figure 4:
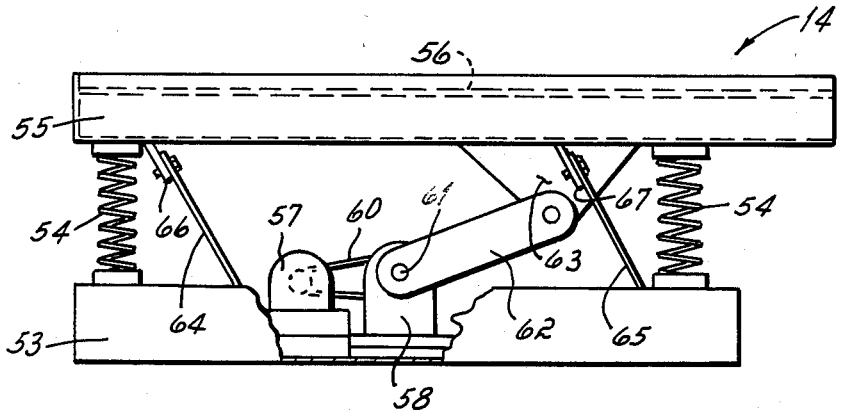
FIG. 4 is a diagrammatic side elevational view of an oscillator conveyor used in practicing the present method.

The overall construction of a preferred form of system 10 for carrying out the present method is illustrated in FIG. 1. The overall construction of certain equipment utilized in this system is illustrated in FIGS. 2–4. It is to be understood, however, that the structural details of this equipment are well known in the art and constitute no part of the present invention.

More particularly, the system 10 comprises a first tumbler 11 and a second tumbler 12. Each of these tumblers includes an elongated rotary drum rotatable about a generally horizontal axis. The axis of each tumbler is slightly inclined downwardly from the inlet end of the tumbler to the discharge end thereof. The drum of the first tumbler is perferably imperforate, while the drum of of the second tumbler includes openings to permit discharge of abrasive members as explained below. The two tumblers are interconnected by conveyors 14 and 15 so that the garments first pass along the length of the first tumbler and are then transferred automatically to the inlet of the second tumbler.

As shown in FIG. 1, the first conveyor 14 is disposed beneath the discharge opening 13 of tumbler 11. Conveyor 14 is a relatively flat oscillating conveyor including a perforated plate, or screen, which supports blue jeans as they move along the conveyor, but permits abrasive members to fall through the conveyor to effect their separation from the blue jeans. Conveyor 14 discharges the blue jeans onto a second conveyor 15 which is preferably a cleated belt-type conveyor which transfers the jeans to the inlet 16 of tumbler 12. The garments which are fed to tumbler 12 through inlet 16 pass along the length of that tumbler and are discharged from the opposite end 17 of that tumbler.

System 10 also includes means for recycling the abrasive members separated from the oscillator conveyor 14 and second tumbler 12 to the loading chute 18 of the first tumbler 11. These means include a belt conveyor 20 which is positioned beneath the discharge of the oscillator conveyor pan and receives abrasive members as they are discharged from that pan. A return chute 21 discharges abrasive members separated by second tumbler 12 onto conveyor 20. Consequently, all of the abrasive members separated from the jeans are transferred by conveyor 20 to a feed chute 22 which directs them to inlet 18 of the first tumbler 11.

The overall construction of the tumblers 11 and 12 is shown in FIGS. 2 and 3 which illustrate tumbler 11. It is to be understood that tumbler 12 is generally similar to tumbler 11, except that the walls of the drum of tumbler 12 are perforate as opposed to the imperforate walls of tumbler 11 and the axis of the drum of tumbler 12 slopes in the opposite direction, i.e., slopes downwardly from right to left as viewed in FIGS. 1 and 2.

As shown in FIG. 2, tumbler 11 comprises a base 23. The base supports vertical frame members 24. These frame members in turn carry longitudinal top members 25 and transverse top members 26. Rotatably mounted within the hollow frame formed by the base and frame members 24–26 is a drum 27. Drum 27 is preferably of polygonal cross-section and, as shown in FIG. 3, in the preferred embodiment, is of hexagonal cross-section. The hexagonal outer walls 28 of the drum are welded, or otherwise secured, to three support ring assemblies 30, 31 and 32. Each support ring assembly comprises an annular ring member 33 of T-shaped cross-section (see FIG. 2). The inner flange section 34 of each ring member is secured to a fillet plate 35 which is in turn welded, or otherwise secured, to the outer wall 28 of drum 27.

The transverse outer rim 36 of each ring member is carried by a plurality of spaced rollers 37 carried by suitable brackets secured to the frame. Rollers 37 are provided with endwise thrust flanges 38 effective to prevent longitudinal movement of the drum. In the preferred embodiment, the hexagonal drum is formed of imperforate steel lined with urethane and is approximately 20 feet in length. The maximum diameter of the drum is approximately five feet.

As shown in FIG. 2, the axis of the drum is generally horizontal, but is slightly angulated with respect to a true horizontal. More particularly, the left-hand, or feed, end of the drum is approximately five inches higher than the right-hand, or discharge, end of the drum. The drum is rotated by means of a motor 40 mounted in a housing 41 atop the frame. The motor is interconnected by means of a belt drive 42 to a gear reducer 43. The output shaft of gear reducer 43 rotates a drive sprocket 44 which drives a chain 45. This chain in turn drives a driven sprocket 46 mounted about the periphery of drum 27. In the preferred embodiment, drum 27 is driven at approximately 20 revolutions per minute.

As shown in FIGS. 2 and 3, the end wall 47 of the drum has a central opening in alignment with the tubular chute 48 which defines discharge opening 13. A similar axial opening in front wall 50 of drums 27 communicates with loading chute 18 forming the inlet to the drum.

It is to be understood that tumbler 12 is generally similar to tumbler 11. However, the inclination of the drum of tumbler 12 is reversed from that of tumbler 11, i.e., the drum slopes downwardly from the right-hand inlet end 51 of the tumbler to the left-hand discharge end 17. Furthermore, the walls of the drum in tumbler 12 are not imperforate, but rather include openings of sufficient size to permit abrasive members to drop through the walls of the tumbler onto a sloping pan mounted beneath the tumbler. This pan slopes downwardly from discharge end 17 of tumbler 12 toward the inlet end 51. The pan empties into a chute 21 from which abrasive members drop onto belt 20. It is to be understood that tumbler 12 further comprises an unloading chute at end 17 similar to chute 13 of tumbler 11.

The drive for the drum of tumbler 12 is substantially like the drive for drum 27 shown in FIG. 2. However, in the preferred embodiment, the motor for driving the drum of tumbler 12 is reversible so that the direction of rotation of the drum of tumbler 12 can be reversed when desired.

The construction of one suitable form of oscillating conveyor for transferring jeans discharged from chute 13 of tumbler 11 onto a conveyor 15 and simultaneously separating abrasive members is illustrated in FIG. 4. As there shown, the oscillator conveyor 14 includes a base 53 which carries spring mounts 54 which support a pan 55 and perforated plate, or wire mesh screen, 56. It is to be understood that the openings in the perforated plate, or wire mesh screen, are of sufficient size to permit abrasive members deposited on the screen to drop through the screen onto pan 55. Screen 56 is oscillated in such a manner as to cause garments deposited on screen 56 to move from left to right in FIG. 4, i.e., from tumbler 11 toward conveyor 15. The pan 55 and screen 56 are also oscillated in such a manner as to cause the abrasive members to drop through screen 56 onto the pan 55 and to be discharged from the right-hand, or open, end of the pan from which they drop onto belt 20.

One suitable form of drive for pan 55 and screen 56 includes a motor 57 mounted upon base 53. The motor drives a gear reduction unit 58 through belt 60. The gear reduction unit 58 has an output shaft which drives a member having an eccentric pin 61. This pin is connected to a connecting link 62 which is pivotally secured to a depending flange 63 mounted on pan 55. Two angulated shaker arms 64 and 65 are interconnected to base 53 and arms 66 and 67 carried by pan 55. These shaker arms function to provide support for pan 55 and control the deflection of the pan in a manner well known in the art.

Figure 5:
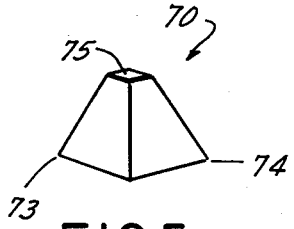
FIG. 5 is a perspective view of an abrasive member for use in practicing the present method.
Figure 6:
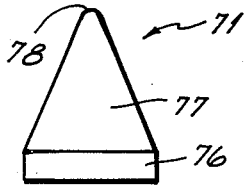
FIG. 6 is an elevational view of an alternate form of abrasive member.

A preferred form of abrasive member 70 for use in practicing the present method is illustrated in FIG. 5 and an alternate form of abrasive member 71 is illustrated in FIG. 6. More particularly, abrasive members 70 and 71 are of a type of resin-bonded, pre-formed abrasive members used for burr removal from metals in conventional metal finishing operations. Each of these abrasive elements is formed from 100 grit sand mixed with a suitable polyester resin. A preferred formulation comprises 30% of a suitable resin, such as Reichold Chemical Co. polyester resin No. 32080, or AZS Corporation polyester resin No. 4732, mixed with 70% by weight of 100 grit sand. It is to be understood, however, that other types of resin and abrasive material can be utilized.

Abrasive member 70 is formed in the shape of a truncated pyramid and, in one preferred form of pyramid, the measurement of the base from corner 73 to corner 74 is approximately 1⅝", while the height of the pyramid from the base to the truncated top 75 is approximately one inch.

Alternative abrasive member 71 is of generally conical configuration including a short cylindrical base section 76 and a main conical section 77 having a slightly rounded top 78. In a preferred embodiment of an abrasive member of this configuration the diameter of base 76 is approximately 1¼", while the height of the member from the bottom surface of the base to the top of rounded conical member 78 is approximately 1¼".

A preferred process of stone washing blue jeans utilizing the system and abrasive members described above involves loading abrasive members and dry blue jeans into the first tumbler 11 through loading chute 18. Blue jeans are loaded and discharged continuously with the rate of travel through the drum being such that the jeans remain in the tumbler area approximately twenty minutes. There are approximately ten blue jeans per foot of lineal machine. Thus, for the 20' machine illustrated in FIG. 1, approximately two hundred blue jeans are fed to the first tumbler. This tumbler is loaded with approximately 9,250 pounds, or 115 cubic feet, of abrasive members. This abrasive members occupies approximately 40% of the internal volume of the drum 27, with a cubic foot of abrasive members being provided for each 1.7 pairs of blue jeans.

No water is added to, or is present in, either the first or second tumblers. The blue jeans are processed in a completely dry condition. The abrasive members and blue jeans are agitated by rotating drum 27 at approximately 20 rpm. As this drum rotates, the jeans move from the loading end of the drum toward the discharge end from which the blue jeans are discharged through discharge chute 13 onto oscillating conveyor 14. This conveyor simultaneously moves the blue jeans toward a second conveyor 15 and separates the abrasive members from the jeans. The abrasive members which are separated drop through the screen of the oscillator conveyor into pan 55 and then drop from the right-hand end of this pan onto belt conveyor 20. This belt conveyor returns the abrasive members to the loading chute 18 of the first tumbler 11.

The blue jeans, largely freed of abrasive members, are dropped onto conveyor 15 and are fed by that conveyor to loading chute 16 of the second tumbler 12. This tumbler again agitates the blue jeans by rotating them in a perforated hexagonal drum. As the blue jeans tumble in the second tumbler, the remaining abrasive members, including any which have been trapped in the pockets of the blue jeans, are separated and drop through the holes in the drum onto a pan (not shown). From this pan, the abrasive members are discharged through chute 21 onto belt 20 which recycles them to the first tumbler.

In a preferred form of the present method, a second tumbler is rotated at 20 rpm and the jeans are held in the tumbler for approximately twenty minutes as they move from the loading chute to the discharge chute. Halfway through this period, the direction of rotation of the tumbler is reversed. This, of course, does not affect the movement of the jeans toward the discharge chute. However, I have found that this reversal of direction materially shortens the length of time required to remove the remaining abrasive members from the jeans.

The fully processed jeans have a faded look which is considered desirable by many customers. The jeans are of substantially uniform appearance throughout, i.e., are free of undesirable streaks.

From the foregoing disclosure of the general principles of the present invention and the above description of a preferred embodiment, those skilled in the art will readily comprehend various modifications to which the invention is susceptible. Therefore, I desire to be limited only by the scope of the following claims.

Having described my invention, I claim:

1. A process for treating new garments comprising the steps of:

feeding said garments in a dry condition to a first elongated tumbler drum rotatable on a generally horizontal axis;

providing abrasive members in said first tumbler drum;

rotating said drum to agitate said garments without contacting said garments with liquid;

discharging said garments from said first tumbler drum;

feeding said garments to an oscillating conveyor effective to separate said abrasive members from said garments;

feeding said garments to a second elongated tumbler drum rotatable about a substantially horizontal axis, said second tumbler drum having perforated walls;

rotating said second tumbler drum to separate abrasive members remaining with said garments and thereafter discharging said treated garments from said second tumbler drum while recycling separated abrasive members to said first tumbler drum.

2. The method of claim 1 in which said abrasive members are resin-bonded, pre-formed elements comprising sand and resin.

3. The method of claim 2 in which said pre-formed abrasive members are in the form of truncated pyramids.

4. The method of claim 3 in which said truncated pyramids are of the order of an inch in height and 1.6 inches in maximum width.

5. The method of claim 3 in which said abrasive members comprise approximately 30% resin and 70% sand.

6. The method of claim 2 in which said abrasive members are of generally conical configuration.

7. The method of claim 6 in which said abrasive members are of the order of an inch in height and an inch in maximum diameter.

8. The method of claim 7 in which said abrasive members comprise approximately 30% sand and 70% resin.

9. The method of claim 2 in which said abrasive members have a height and a maximum transverse dimension of the order of one inch.

10. The method of claim 1 in which said tumbler drums are of polygonal cross-section.

11. The method of claim 10 in which said tumbler drums are rotated at approximately 20 revolutions per minute.

12. The method of claim 11 in which the direction of rotation of said second tumbler drum is reversed while garments are in said tumbler drum.

13. The method of claim 10 in which said garments are blue jeans and in which approximately ten pairs of blue jeans are disposed within said first tumbler drum per lineal foot of said tumbler.

14. The method of claim 13 in which said first tumbler drum is filled with approximately 5.75 cubic feet of abrasive members per ten pairs of blue jeans.

15. The method of claim 10 in which said first tumbler drum is approximately 40% filled with abrasive members.

16. The method of claim 15 in which said first tumbler drum is rotated approximately 20 revolutions per minute.

17. The method of claim 16 in which said blue jeans remain in the first tumbler drum for approximately 20 minutes.

18. The method of claim 10 in which said garments are blue jeans and in which said blue jeans are fed continuously to said first tumbler drum and discharged continuously from said second tumbler drum.

* * * * *